US010361495B2

(12) United States Patent
Huber et al.

(10) Patent No.: US 10,361,495 B2
(45) Date of Patent: Jul. 23, 2019

(54) ELECTRICAL CONNECTOR FOR A MULTI-WIRE ELECTRICAL CABLE

(71) Applicant: MD ELEKTRONIK GmbH, Waldkraiburg (DE)

(72) Inventors: Martin Huber, Obing (DE); Josef Ohni, Kraiburg a. Inn (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 0 days.

(21) Appl. No.: 15/802,475

(22) Filed: Nov. 3, 2017

(65) Prior Publication Data

US 2018/0145431 A1 May 24, 2018

(30) Foreign Application Priority Data

Nov. 23, 2016 (EP) ..... 16200230
Nov. 23, 2016 (EP) ..... 16200232
Nov. 23, 2016 (EP) ..... 16200233

(51) Int. Cl.
*H01R 9/03* (2006.01)
*H01R 9/053* (2006.01)
(Continued)

(52) U.S. Cl.
CPC ..... *H01R 9/032* (2013.01); *H01R 9/053* (2013.01); *H01R 13/6589* (2013.01);
(Continued)

(58) Field of Classification Search
CPC .. H01R 4/64; H01R 13/65802; H01R 23/688; H01R 2103/00; H01R 13/658; H01R 13/719
(Continued)

(56) References Cited

U.S. PATENT DOCUMENTS 6,314,182 B1 11/2001 Brandt
6,764,342 B2 * 7/2004 Murayama ..... H01R 4/023 439/607.1
(Continued)

FOREIGN PATENT DOCUMENTS

DE 102009049132 A1 5/2010
DE 202012102811 U1 8/2012
(Continued)

*Primary Examiner* — Thanh Tam T Le

(74) *Attorney, Agent, or Firm* — Leydig, Voit & Mayer, Ltd.

(57) ABSTRACT

An electrical connector for a multi-wire electrical cable includes at least two cable-side electrical contact elements including associated electrical terminals to each of which is to be connected a wire of the electrical cable. At least two output-side electrical contact elements, from each of which projects an electrical connector element by which an electrical connection can be established to a mating connector. An electrically conductive carrier body is disposed between the cable-side contact elements and the output-side contact elements. The electrically conductive carrier body carries an electrical device by which the cable-side contact elements and the output-side contact elements are electrically connected to each other. The electrical device is supported by the carrier body without any of the cable-side contact elements or the output-side contact elements being in electrical contact with the carrier body through the electrical device.

16 Claims, 12 Drawing Sheets

(51) Int. Cl.

| | |
|---|---|
| ***H01R 13/6589*** | (2011.01) |
| ***H01R 13/6592*** | (2011.01) |
| ***H01R 13/719*** | (2011.01) |
| *H01R 4/18* | (2006.01) |
| *H01R 13/506* | (2006.01) |
| *H01R 13/6471* | (2011.01) |
| *H01R 103/00* | (2006.01) |
| *H01R 24/30* | (2011.01) |

(52) U.S. Cl.
CPC ..... *H01R 13/6592* (2013.01); *H01R 13/719* (2013.01); *H01R 4/183* (2013.01); *H01R 13/506* (2013.01); *H01R 13/6471* (2013.01); *H01R 24/30* (2013.01); *H01R 2103/00* (2013.01)

(58) Field of Classification Search
USPC ..... 439/92, 95, 101, 108, 579, 607.41, 439/620.13
See application file for complete search history.

(56) References Cited

U.S. PATENT DOCUMENTS

| | | | | |
|---|---|---|---|---|
| 6,786,763 | B2 * | 9/2004 | Wu | H01R 13/6585 439/497 |
| 6,923,682 | B2 * | 8/2005 | Akama | H01R 24/562 439/607.47 |
| 7,607,948 | B1 | 10/2009 | Lee | |
| 8,734,183 | B2 * | 5/2014 | Omae | H01R 4/34 439/607.01 |
| 8,870,597 | B2 * | 10/2014 | Kawakami | H01R 13/6471 439/108 |
| 8,986,053 | B2 * | 3/2015 | Hermann | H01R 4/38 439/792 |
| 2004/0192098 | A1 | 9/2004 | Pavlovic et al. | |
| 2005/0133245 | A1 | 6/2005 | Katsuyama et al. | |
| 2009/0262968 | A1 | 10/2009 | Akino | |
| 2013/0241281 | A1 | 9/2013 | Brunelet et al. | |
| 2013/0273775 | A1 | 10/2013 | Chien | |
| 2014/0220798 | A1 | 8/2014 | Putt, Jr. et al. | |
| 2018/0145465 | A1 * | 5/2018 | Huber | H01R 13/415 |

FOREIGN PATENT DOCUMENTS

| | | | |
|---|---|---|---|
| DE | 102015003935 | B3 | 6/2016 |
| EP | 2765653 | A1 | 8/2014 |
| GB | 1350087 | A | 4/1974 |
| WO | WO 0011760 | A1 | 3/2000 |
| WO | WO 2005069445 | A1 | 7/2005 |
| WO | WO 2012014072 | A1 | 2/2012 |

* cited by examiner

ELECTRICAL CONNECTOR FOR A MULTI-WIRE ELECTRICAL CABLE

CROSS-REFERENCE TO PRIOR APPLICATIONS

Priority is claimed to European Patent Application Nos. EP 16200230.7, EP 16200232.3 and EP 16200233.1, each filed on Nov. 23, 2016, the entire disclosure of each being hereby incorporated by reference herein.

FIELD

The present invention relates to an electrical connector for a multi-wire electrical cable.

Such an electrical connector includes on its input or cable side at least two electrical contact elements, for example in the form of contact plates, to each of which is connected a wire of the associated electrical cable (via a suitable terminal), and further includes on its output side at least two electrical contact elements, for example in the form of contact plates, from each of which extends an electrical connector element, for example in the form of an electrically conductive pin, to allow an electrical connection to be made therethrough to a mating connector.

This is a classical construction of an electrical connector for multi-wire electrical cables, to which connector an electrical cable is attached on the input side and which connector is provided with electrical connector elements on the output side to allow the electrical cable to be brought into electrical connection with a mating connector via the electrical connector, and especially the connector elements thereof.

BACKGROUND

With regard to the technical background of the present invention, reference may be made, for example, to WO 2005/069445 A1. In connection with the transmission of signals through electrical cables, signal conditioning is typically very important. For this purpose, suitable electrical devices are placed in the signal path. This results in increased space requirements to accommodate such devices.

SUMMARY

In an embodiment, the present invention provides an electrical connector for a multi-wire electrical cable. At least two cable-side electrical contact elements include associated electrical terminals to each of which is to be connected a wire of the electrical cable. At least two output-side electrical contact elements, from each of which projects an electrical connector element by which an electrical connection can be established to a mating connector. An electrically conductive carrier body is disposed between the cable-side contact elements and the output-side contact elements. The electrically conductive carrier body carries an electrical device by which the cable-side contact elements and the output-side contact elements are electrically connected to each other. The electrical device is supported by the carrier body without any of the cable-side contact elements or the output-side contact elements being in electrical contact with the carrier body through the electrical device.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
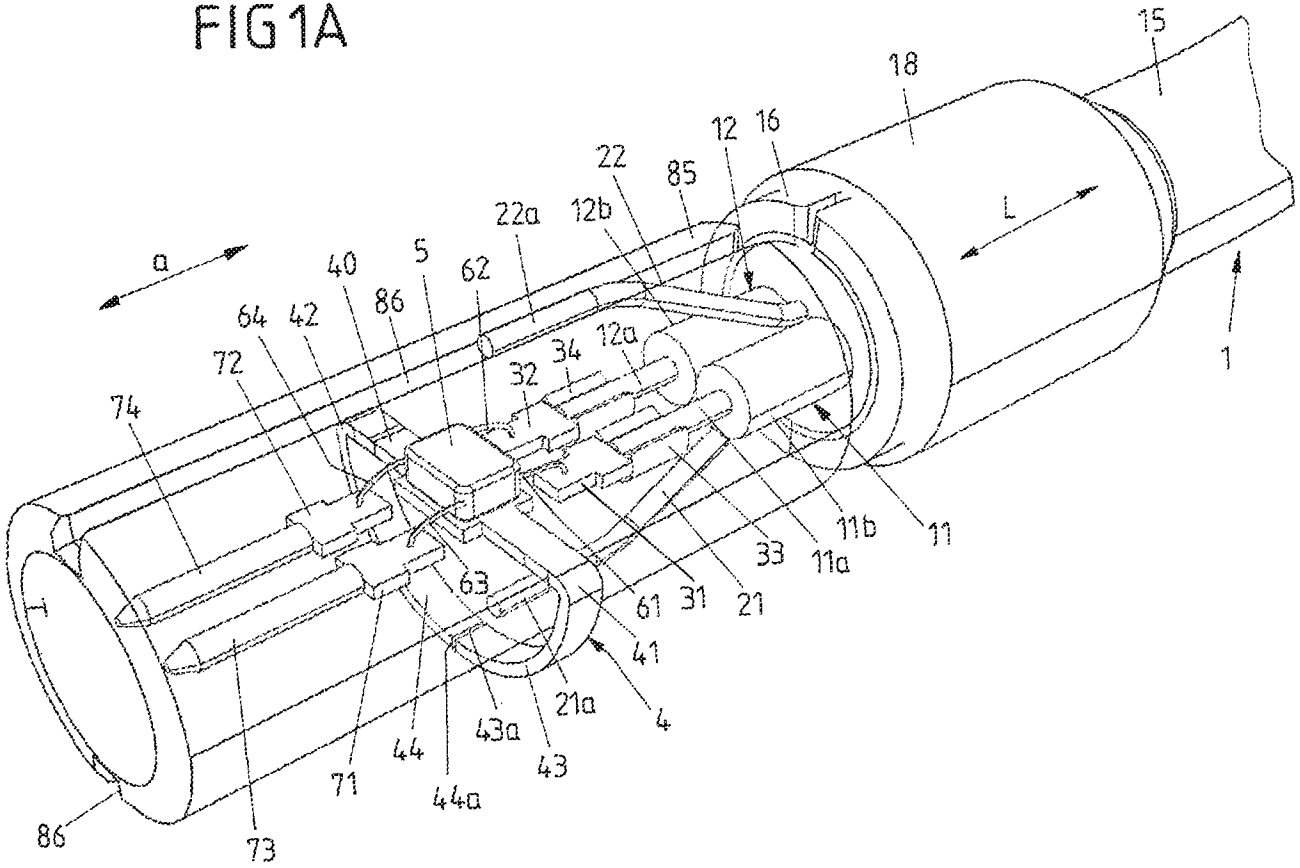
FIG. 1A shows, in partially transparent view, an electrical connector for a multi-wire electrical cable, with a carrier body disposed on the input side for an electrical device, but without the associated outer conductor.

An embodiment of the present invention provides an improved electrical connector of the above-mentioned type with respect to the aforedescribed requirements.

According to an embodiment, in an electrical connector of the above-mentioned type, it is further provided that a carrier body be disposed between the cable-side (input-side) electrical contact elements of the connector, on the one hand, and its output-side electrical contact elements, on the other hand, which carrier body carries an electrical device via which at least two of the cable-side contact elements and at least two of the output-side contact elements are electrically connected to each other, the electrical device being supported by the carrier body without electrically contacting the same. This means, in particular, that none of the cable-side or output side contact elements is in electrical contact with the carrier body via the electrical device. In other words, as a (functional) result of the (inventive, structural) feature that no electrical contact exists between the electrical device and the carrier body, neither any of the cable-side contact elements nor any of the output-side contact elements can be in electrical contact with the carrier body via the electrical device.

The approach of an embodiment of the present invention makes it possible to dispose at least one electrical device on the input side of a connector, between the electrical cable attached to the connector and the output-side contact elements of the connector, from which project the connector elements thereof. Since the carrier body specifically serves to support the (at least one) electrical device, but not to electrically contact the same, the carrier body can be specifically optimized for that function; i.e., with respect to its mechanical properties.

For example, the carrier body may be specifically designed to reliably accommodate forces, such as torsional forces, and it may serve as a stop and locking means for other components, such as, for example, for an outer conductor of the connector.

In an embodiment, the carrier body, on the one hand, forms a support region which extends from a first connecting section to a second connecting section and on which is placed the electrical device, and, on the other hand, a supporting section of the carrier body extends from each of the two connecting sections of the carrier body in such a way that the support region and the two supporting sections form a ring-shaped (e.g., stirrup-shaped) circumferential structure. Such a structure is particularly suitable for accommodating torsional forces.

The two supporting sections may each extend along an arcuate path. Moreover, the two supporting sections may each have a free end (spaced from the respective connecting section of the support region) and may be formed such that the free ends of the two supporting sections are disposed opposite one another and face each other (and optionally contact each other).

The carrier body may be formed as a single piece, so that the supporting sections thereof were positioned by bending in such a way that they form an annular (in particular stirrup-shaped) contour together with the support region of the carrier body.

The electrical device, which is placed on the carrier body without being electrically contacted thereto, may be connected, for example by wires, to the cable-side contact elements, on the one hand, and to the output-side contact elements, on the other hand, and specifically in such a way that the cable-side and output-side contact elements are connected to each other pairwise via the electrical device.

If the connector components, such as the cable-side and output-side contact elements as well as the carrier body, are enclosed by an outer conductor (e.g., an electrically conductive outer tube), the carrier body may be connected to the outer conductor, in particular in a form-fitting manner and/or by a material-to-material bond.

In this case, the carrier body is disposed partially within the space surrounded by the outer conductor, and specifically in such a way that the electrical device supported by the carrier body is also located within the space surrounded by the outer conductor. At the same time, the carrier body may partially extend out of the outer conductor, for example through slots of the outer conductor.

Specifically, the carrier body may be disposed such that its support region, together with the electrical device supported thereon, is located within the space enclosed by the outer conductor, and that the carrier body extends out of the outer conductor at its connecting sections. The supporting sections of the carrier body may partially enclose the outer conductor on its outer side.

Advantageously, the supporting sections of the carrier body are not bent over until the support region of the carrier body, together with the electrical device placed thereon, has been disposed within the space enclosed by the outer conductor and the supporting sections of the carrier body have been positioned to extend out of the outer conductor, for example through slots of the outer conductor.

In an embodiment of the present invention, the input-side (cable-side) and output-side electrical contact elements as well as the carrier body for the electrical device have been manufactured and incorporated into the connector as parts of a single, integrally formed component, for example in the form of a stamped conductor pattern. Subsequently, the stamped conductor pattern is separated into the separate components, namely the input side (cable-side) electrical contact elements, the output-side electrical contact elements, and the carrier body, so that the individual cable-side contact elements and the output-side contact elements as well as the carrier body are present as separate components which are not (electrically) connected to each other.

Figure 1B:
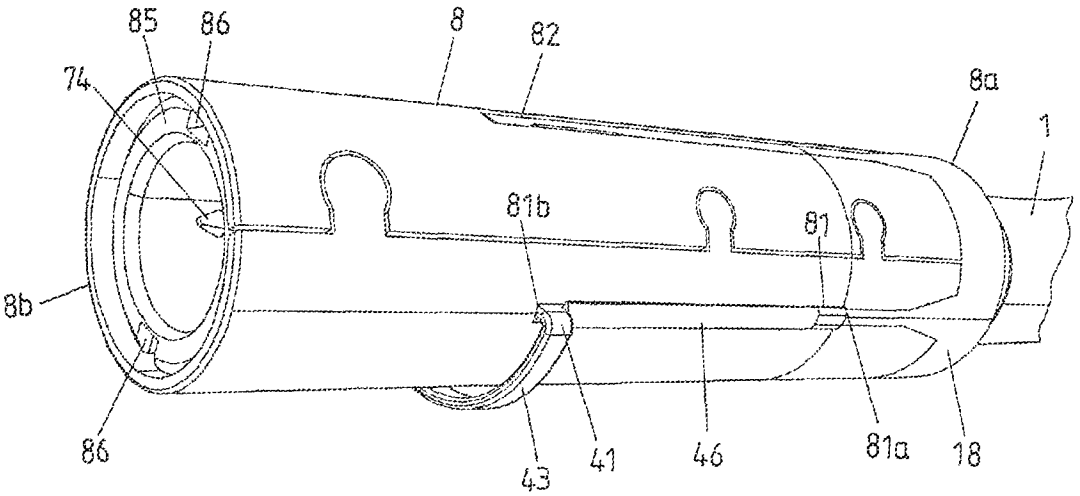
FIG. 1B shows the electrical connector of FIG. 1A together with the associated outer conductor.

FIGS. 1A and 1B show an electrical connector to which a multi-wire electrical cable 1 (shown in cross-section in FIG. 2A) is attached on the input side, and which has electrical connector elements 73, 74 on the output side for establishing an electrical connection to a mating connector. In the exemplary embodiment, electrical cable 1 takes the form of a two-wire electrical cable. The two wires 11, 12 of cable 1 extend side-by-side along longitudinal cable direction L, forming parallel wires. These are each composed of an electrical conductor 11*a*, 12*a*, for example of copper, as well as an insulating sheath 11*b*, 12*b* surrounding the respective conductor.

Wires 11, 12 of cable 1 are arranged together within a cable interior which is defined by a cable jacket 15 extending in longitudinal cable direction L and which is annularly surrounded by cable jacket 15, as viewed in cross section. Cable jacket 15 is composed of an electrically insulating material.

Moreover, a cable shield 14 is disposed between cable jacket 15 and the cable interior, which serves to receive wires 11, 12. Cable shield 14 may be formed, for example, by a braided shield or a film, or by a braided shield in combination with a film. Cable shield 14 is used for shielding the interior of the cable and for this purpose is made of a metallic material, such as, for example, aluminum. Thus, for example, a cable shield 14 in the form of a film may be an aluminum foil. Alternatively, it is possible to use for this purpose a plastic film that is coated with an electrically conductive material, such as aluminum, in particular on its inner surface facing the interior of the cable.

Braided shields are used, in particular, for shielding in the case of relatively low frequencies, while cable shields in the form of films are used for shielding in the case of relatively high frequencies (1 MHz to 10 GHz).

Figure 2B:
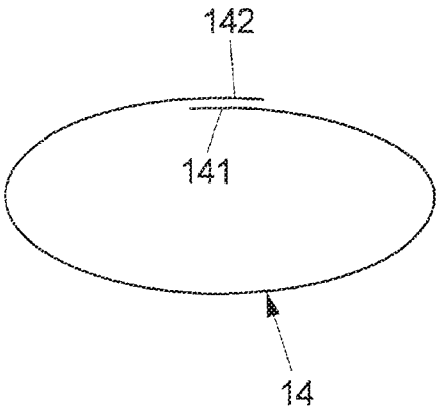
FIG. 2B shows a schematic view of a cable shield of the electrical cable.

FIG. 2B schematically shows a possible specific embodiment of a cable shield 14. Here, cable shield 14 takes the form of a film and is placed around the interior of the cable in such a way that the two connecting portions 141, 142 of the film overlap each other in the circumferential direction. When the interior of the cable has to be accessed (for example, during pre-termination of the cable), cable shield 4 can be selectively opened in the resulting overlap region.

Cable shield 14 and cable jacket 15 may be combined into one unit, for example by bonding the outer surface of cable shield 14, which faces away from the interior of the cable, to cable jacket 15, for example by an adhesive.

In the present case, in addition to wires 11, 12, stranded drain wires 21, 21 are disposed in the cable interior, each extending, together with wires 11, 12, along longitudinal cable direction L. Stranded drain wires 21, 22 are electrically conductive and not insulated and are in electrical contact with cable shield 14. Such stranded drain wires 21, 22 are used to bring cable shield 14 to ground potential in a defined manner, and advantageously to do so even when cable shield 14 is locally damaged, such as when a cable shield 14 in the form of a film is torn in some sections. Moreover, stranded drain wires 21, 22 may, in addition, contribute to the shielding of the cable interior.

Figure 2A:
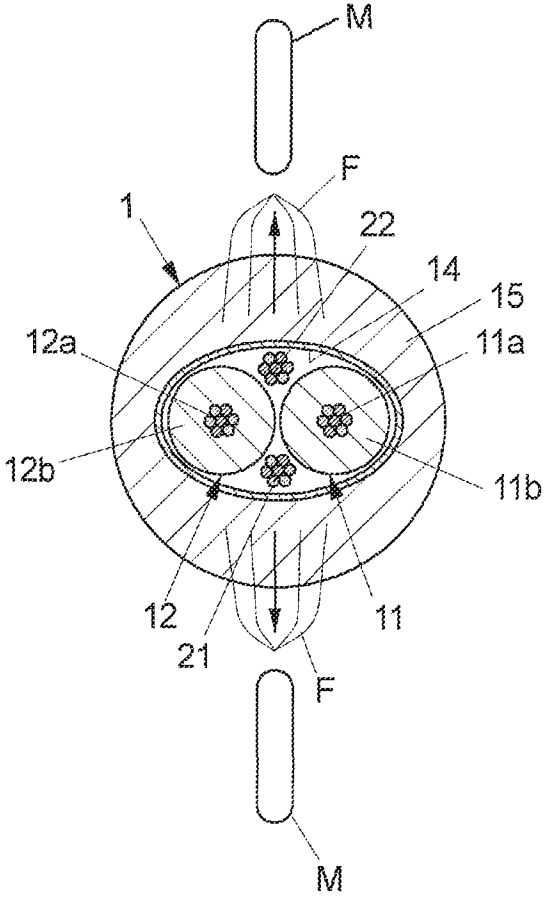
FIG. 2A shows a cross section through the electrical cable attached to the connector of FIG. 1A.

For purposes of pre-terminating the cable of FIG. 2A, for example, to provide the cable with an electrical connector 1 as shown in FIGS. 1A and 1B, stranded drain wires 21, 22 must be separated from wires 11, 12 to enable a respective cable component to be moved to the connector region intended for this purpose. To facilitate such assembly work, a respective stranded drain wire 21, 22 may include a magnetic, in particular ferromagnetic material. This material may be an alloy (based on iron, nickel, cobalt), in particular steel.

In a variant, a respective stranded drain wire 21, 22 is completely made of an electrically conductive ferromagnetic material. In another variant, a respective stranded drain wire 21, 22 includes at least one core made of a ferromagnetic material and surrounded by an electrically conductive material. This embodiment makes it possible, on the one hand, to optimize the core of a respective stranded drain wire 21, 22 with respect to the magnetic properties and to optimize the conductive outer portion of a respective stranded drain wire 21, 22 with respect to the electrical properties (also with respect to the skin effect at high frequencies). Thus, a respective stranded drain wire 21, 22 may be composed, for example, of a core of steel coated with copper. The coating may be applied, for example, by electrodeposition.

Both a respective wire 11, 12 and a respective stranded drain wire 21, 22 of electrical cable 1 of FIGS. 1A, 1B and 2A are normally composed of a plurality of strands.

For purposes of pre-terminating electrical cable 1 of FIG. 2A, for example, to attach it to an electrical connector as shown in FIGS. 1A and 1B, cable jacket 15 is removed from a connecting portion of cable 1 (at the connector end thereof). In the exemplary embodiment, magnetic forces are used to separate stranded drain wires 21, 22 from wires 11, 12 of the cable, for example to enable those cable components 11, 12; 21, 22 to be moved separately to the corresponding terminals of the connector of FIG. 1. For this purpose, as can be seen from FIG. 2A, a magnet M is approached to a respective stranded drain wire 21, 22 at the connector-side cable end after cable jacket 15 has been cut open at the respective cable end. Magnet M produces a magnetic field F which, because of the ferromagnetic material included in the stranded drain wire, tends to move the respective stranded drain wire 21, 22 out of the interior of the cable, as is apparent from the configured state of cable 1 shown in FIG. 1A. In this way, stranded drain wires 21, 22 can be easily separated from wires 11, 12 of the cable without having to manipulate wires 11, 12 and/or stranded drain wires 21, 22 with tools.

What is essential to the method described herein is that a respective stranded drain wire 21, 22 include a material having such magnetic properties that stranded drain wire 21, 22 can be separated from wires 11, 12 of cable 1 under the action of magnetic forces. This means that the magnetic properties of stranded drain wire 21, 22 must differ from those of a respective wire 11, 12.

By lifting a respective stranded drain wire 21, 22 out of the interior of the cable under the action of magnetic forces, it is possible to automatically open a cable shield 14 formed by a film of the type shown in FIG. 2B. This merely requires that the ends 141, 142 of cable shield 14 move away from one another under the action of the outwardly moving stranded drain wires 21, 22.

The connector-side end of cable 1 has a support crimp 16 placed thereon, which may (optionally) be surrounded by a potting body 18, for example in the form of a ferrite core filter overmold. Such a (ferrite core) filter on the cable side functions here as a sheath current filter, especially to suppress sheath currents in the form of high-frequency common-mode interferences, which are caused, for example, by electrical devices and propagate along cable 1. Thus, this filter serves to eliminate or reduce common-mode interferences which occur in co-phasal relationship in the two parallel wires 11, 12 or electrical conductors 11*a*, 12*a* and which, in the present example, are caused in particular by sheath currents.

The connector adjacent to the connector-side end of cable 1 includes an outer conductor 8, which in the exemplary embodiment takes the form of an outer tube, and which is composed of an electrically conductive material and surrounds the connector annularly, or in the exemplary embodiment specifically circularly, as viewed in cross section. Outer conductor 8 extends along a longitudinal direction (longitudinal cable direction L); i.e., axially from a first, cable-side end 8*a* to a second, output-side end 8*b*, and may be connected to a support crimp 16, for example by a material-to-material bond (by welding).

Outer conductor 8 has a pair of first slots 81 and a pair of second slots 82. In the present case, the slots 81 or 82 of a respective pair of slots are disposed opposite each other on outer conductor 8. Moreover, in the exemplary embodiment, the slots 81 of the first pair of slots are offset from the respective slots 82 of the second pair of slots by 90° in the circumferential direction of outer conductor 8.

Slots 81 and 82 each extend in the axial direction a of the connector (and thus also along longitudinal cable direction L) to the cable-side axial end of outer conductor 8 (where they form an open end of the respective slot).

The connector components disposed in the interior space of the connector, which is enclosed by outer conductor 8, include, on the input side (i.e., on the cable side), first, cable-side electrical contact elements 31, 32, here in the form of contact plates. Each of these has integrally formed therewith a terminal in the form of a receptacle 33, 34 for a respective (stripped) electrical conductor 11*a* or 12*a* of wires 11, 12 of electrical cable 1. By fixing the electrical conductor 11*a*, 12*a* (conductive core) of a respective wire 11, 12 of cable 1 in the respectively associated receptacle 33, 34, electrical contact is provided through the respective (electrically conductive) receptacle 33, 34 to a respectively associated cable-side electrical contact element 31, 32.

On the output side (and spaced axially apart from cable-side contact elements 31, 32), the connector has second, output-side contact elements 71, 72 (in the interior space enclosed by outer conductor 8), each of which has integrally formed therewith a connector element 73 or 74, which here takes the form of a connector pin and via which the connector is electrically connectable to a mating connector. In the exemplary embodiment, connector elements 73, 74 project from the respectively associated output-side contact elements 71, 72 in axial direction a.

A carrier body 4 is disposed between cable-side contact elements 31, 32 and output-side contact elements 71, 72 (in spaced contact-free relationship thereto). Carrier body 4 carries an electrical device 5, for example in the form of an electric filter element. The term "electrical device," as used herein, explicitly includes electronic devices and, in particular, semiconductive devices, as well as active and passive electrical devices. In particular, the electrical device may be a passive electrical filter, such as, for example, a common mode filter (common mode choke, CMC filter).

Carrier body 4 serves for supporting and positioning electrical component 5 within the connector. However, it does not serve to electrically connect electrical device 5; i.e., there is no electrical contact between electrical device 5 and carrier body 4. Moreover, carrier body 4 does not have any conductive traces or other elements via which electrical signals could be fed to or picked up from electrical device 5. Nevertheless, carrier body 4 may be composed of an electrically conductive material, especially if electrical device 5 is accommodated in an insulating housing. Electrical device 5 may be joined via its housing to carrier body 4 by a material-to-material bond, for example by soldering, brawelding or adhesive bonding.

Electrical device 5 is electrically connected via bonding wires 61, 62, 63, 64 to cable-side contact elements 31, 32, on the one hand, and to output-side contact elements 71, 72, on the other hand. This means that wires 11, 12 of electrical cable 1 are electrically connected via electrical device 5 to the respective connector elements 73, 74 of the connector. Thus, electrical signals which are fed to the connector via wires 11, 12 of electrical cable 1 pass through electrical device 5 before they are output via connector elements 73, 74 to a mating connector and thus to an electrical unit associated with the mating connector.

In particular, the cable-side (input-side) contact elements 31, 32, on the one hand, and the output-side contact elements 71, 72, on the other hand, may be electrically connected to each other pairwise via electrical device 5. That is, each of cable-side contact elements 31, 32 is connected via electrical device 5 to a respective one of output-side contact elements 71, 72, as will be explained hereinafter in more detail with reference to FIGS. 4A and 4B. In the case of an electrical device 5 in the form of a common mode filter, such a configuration makes it possible to eliminate or reduce common-mode interferences which occur (simultaneously) in the two parallel wires 11, 12 or electrical conductors 11*a*, 12*a*.

In the present case, carrier body 4 takes the form of a stirrup-shaped carrier bracket. For purposes of holding electrical device 5, carrier body 4 has a (flat) support region 40 extending (straight) between a first connecting section 41 and a second connection section 42. In the exemplary embodiment, support region 40 is oriented transverse to axial direction a of the connector. Electrical device 5 is placed on support region 40 of carrier body 4.

A supporting section 43, respectively 44, of carrier body 4 extends from a respective one of the connecting sections 41, 42 at support region 40 of carrier body 4. The respective supporting section extends in a curved (arcuate) path along outer conductor 8 in the circumferential direction. The two supporting sections 43, 44 of carrier body 4, together with support region 40, form an annular contour. In the exemplary embodiment, support region 40 of carrier body 4 extends (in the manner of a secant) straight and transverse to axial direction a between opposite points of outer conductor 8.

In the region of first and second connecting sections 41, 42 of support region 40, carrier body 4 extends radially through a respective first slot 81 of outer conductor 8. That is, support region 40 of carrier body 4 is located substantially inside the space surrounded by outer conductor 8, so that, in particular, the electrical device 5 placed on carrier body 4 is also disposed inside that interior space. However, in the region of its connecting sections 41, 42, carrier body 4 is configured to extend radially out of the interior space of outer conductor 8 (through a respective one of first slots 81).

Accordingly, supporting sections 43, 44 of carrier body 4, which extend from connecting sections 41, 42, extend outside of the space enclosed by outer conductor 8. In the exemplary embodiment, supporting sections 43, 44 each extend in an arcuate path along the outer wall of outer conductor 8 in the circumferential direction. Together, the two supporting sections 43, 44 embrace outer conductor 8 over an angle of about 180° in the circumferential direction.

Supporting sections 43, 44 of carrier body 4 each have a free end 43*a*, 44*a* pointing away from the respective connecting section 41 or 42, at which the respective supporting section 43, 44 extends from support region 40 of carrier body 4. Free ends 43*a*, 44*a* of supporting sections 43, 44 are disposed opposite one another and face each other, so as to form the described annular contour together with support region 40. In the exemplary embodiment, free ends 43*a*, 44*a* are (slightly) spaced apart. In another embodiment, they may also contact each other.

The stranded drain wires 21, 22 extending from electrical cable 1 are disposed with their respective free end portions 21*a*, 22*a* in second slots 82 of outer conductor 8, so that second slots 82 are partially closed by stranded drain wires 21, 22. Stranded drain wires 21, 22 may be fixed within the respective second slots 82 by a material-to-material bond, for example by soldering, brazing or welding. This will be described below in more detail with reference to FIGS. 5A and 5B.

The space between outer conductor 8 and the connector components 31-34, 4, 40, 5, 61-64 and 71-74 disposed therein is partially filled with a potting body 85 (potting compound), for example in the form of an injection-molded part. In the present case, the potting body is disposed on the inner side of outer conductor 8 facing the interior of the connector and, together with outer conductor 8, encloses the aforementioned components 31-34, 4, 40, 5, 61-64 and 71-74 of the connector. Potting body 85 has channels 86 in which the free end portions 21*a*, 22*a* of stranded drain wires 21, 22 are received and guided.

In addition to the aforedescribed functions as a holder for electrical device 5, carrier body 4 may, as a (multi-)functional bracket, also perform a plurality of additional functions on the connector.

For example, in the present case, carrier body 4 serves as a positioning means for positioning outer conductor 8 on the connector. Specifically, such positioning of outer conductor 8 relative to carrier body 4 is done by sliding outer conductor 8 with its first slots 81, which are open on the cable side (i.e., at the respective ends 81*a* facing electrical cable 1), over carrier body 4, more specifically over connecting sections 41, 42 of carrier body 4, until the closed ends 81*b* of the slots 81, which are opposite the open cable-side ends 81*a*, come into engagement with carrier body 4, as illustrated in FIG. 1B. That is, closed ends 81*b* of slots 81 serve as stops for the positioning of outer conductor 8 on carrier body 4 (along longitudinal cable direction L).

At the same time, outer conductor 8 is thus disposed in a form-fitting manner on carrier body 4 (via first slots 81). In addition, outer conductor 8 may also be connected by a material-to-material bond to carrier body 4, such as by welding.

At its open, cable-side end 81*a*, a respective first slot 81 of outer conductor 8 may be formed with an entry bevel, so as to prevent outer conductor 8 from being damaged while being slid onto carrier body 4.

In a refinement of the present invention, carrier body 4 may have axially extending projections 46 which (partially) cover first slots 81 (compare FIG. 1B) when carrier body 4 and outer conductor 8 are aligned and positioned as intended relative to one another. Such projections 46 may also serve as guide means for guiding outer conductor 8 as it is slid onto carrier body 4. Furthermore, the projections may act as an EMC labyrinth; i.e., not only may they reduce the clear line of sight, but they may also counteract entry of electromagnetic waves into the space inside outer conductor 8.

In the exemplary embodiment, further functions of carrier body 4 include relieving the connector components 31-34, 4, 40, 5, 71-74 located in the interior space of outer conductor 8 from tensile and compressive strains when forces/torques are acting on outer conductor 8, as well as relieving stranded drain wires 21, 22 from tensile and compressive strains, especially when torsional forces are acting (along the circumferential direction of outer conductor 8). This makes it possible to prevent shearing off of stranded drain wires 21, 22.

In addition, a keyed housing may be positioned and snapped onto carrier body 4. Moreover, a capacitor may be disposed between carrier body 4 and contact elements 31, 32; 71, 72 to provide for (capacitor-based) AC decoupling.

Figure 3A:
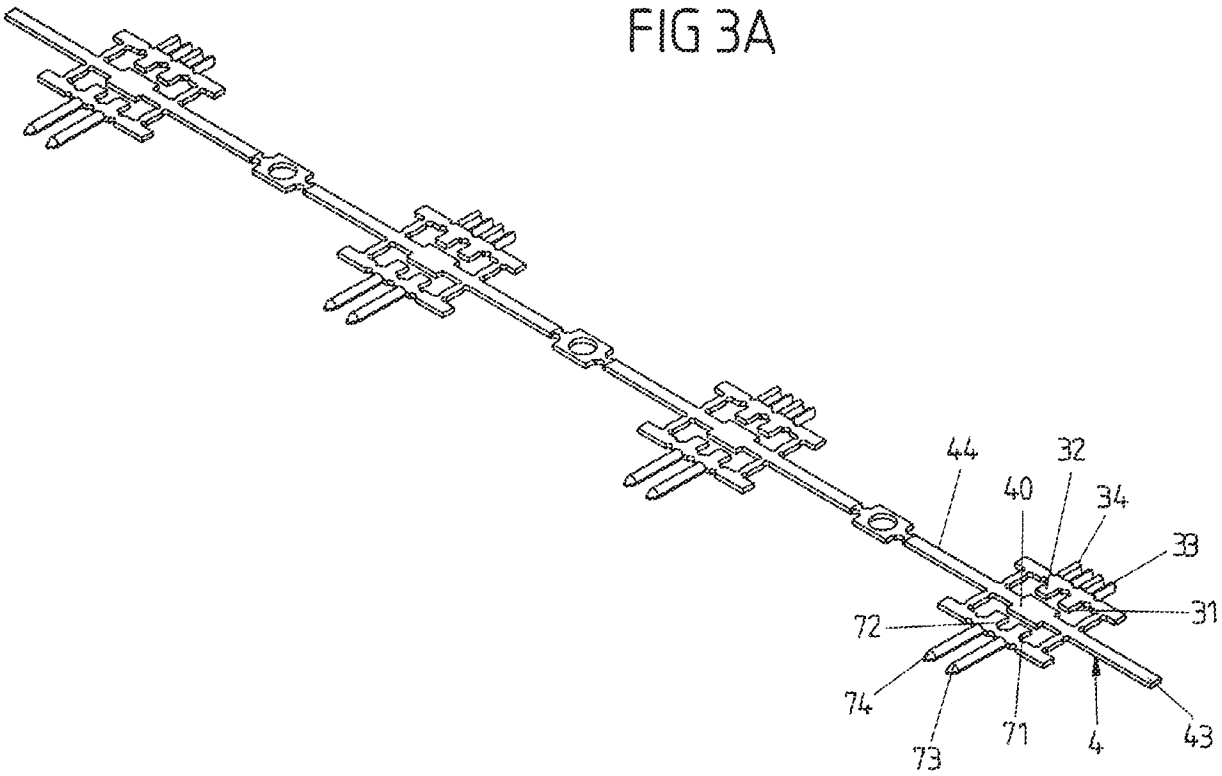
FIG. 3A shows an array of a plurality of stamped conductor patterns, from each of which components of the connector of FIG. 1A, including its carrier body, are formed by separating them.

FIG. 3A shows a stamped conductor pattern from which the connector components 31-34, 4 and 71-74 located within outer conductor 8 may be fabricated; i.e., cable-side electrical contact elements 31, 32 including the associated receptacles 33, 34, carrier body 4 including its support region 40, as well as output-side electrical contact elements 71, 72 along with the associated connector elements 73, 74. As also shown in FIG. 3A, a plurality of such stamped conductor patterns may be provided as an endless strip.

In the condition shown in FIG. 3A, carrier body 4 has not yet been formed into the ring shape or stirrup shape, which it is intended to have according to FIGS. 1A and 1B. Rather, in FIG. 3A, the material region from which stirrup-shaped carrier body 4 will finally be formed is flat along its extent.

In order for the components 31-34, 4 and 71-74 incorporated in the stamped conductor pattern to be installed in the connector, outer conductor 8 may be slid over the laterally projecting wings of carrier body 4 (i.e., the later connecting and supporting sections 41, 43; 42, 44), compare FIG. 3B.

Figure 3B:
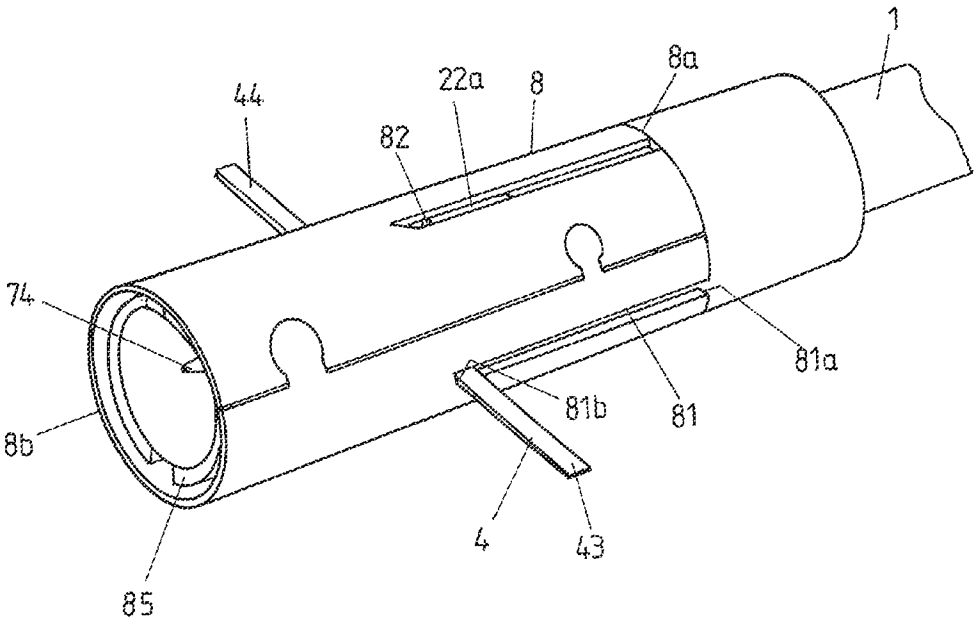
FIG. 3B shows the connector of FIG. 1A prior to configuring the carrier body.

Once carrier body 4 and outer conductor 8 are positioned relative to one another as intended, which is when outer conductor 8 engages carrier body 4 with the closed ends 81*b* of its first slots 81, which act as stops, as shown in FIG. 3B, the final configuration of the components incorporated in the stamped conductor pattern is performed. To this end, firstly, carrier body 4 is bent into the condition shown in FIGS. 1A and 1B, in which its supporting sections 43, 44 extend along the outer circumference of outer conductor 8.

Furthermore, the components of the stamped conductor pattern are cut apart (e.g., through a mounting opening provided in outer conductor 8), so that a total of five separate elements are obtained, namely two separate and spaced-apart cable-side contact elements 31, 32, each having a receptacle 33 or 34 integrally formed therewith, as well as two separate and spaced-apart output-side electrical contact elements 71, 72, each having a connector element 73 or 74 integrally formed therewith, the last-mentioned contact elements 71, 72 in addition being separated and (axially) spaced-apart from the first-mentioned contact elements 31, 32. Finally, there is a fifth element, which constitutes carrier body 4 and which in the exemplary embodiment is separated and spaced-apart from all electrical contact elements 31, 32, 71, 72.

The cutting apart of the aforementioned components 30-34, 4, 71-74 may be accomplished, for example, by cutting through the webs that join those components in the stamped conductor pattern.

Figure 3C:
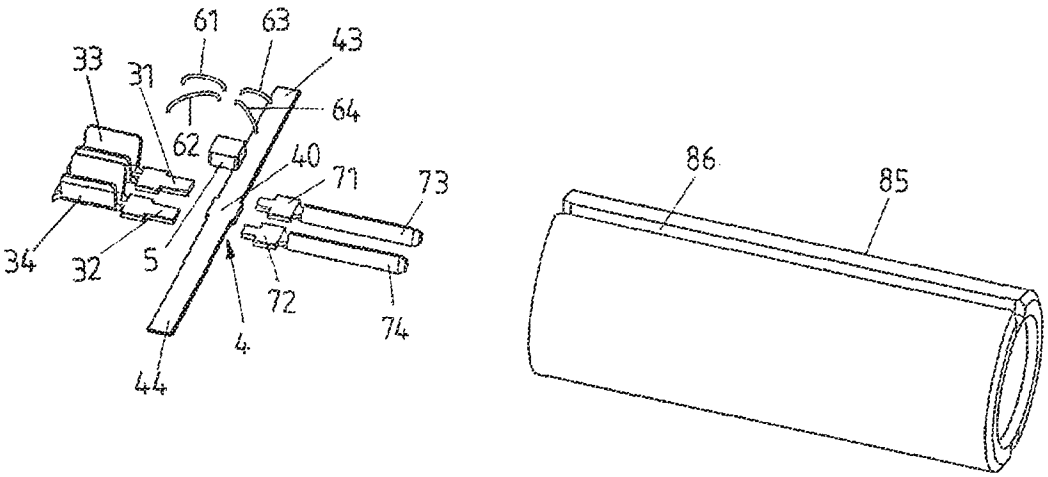
FIG. 3C shows a portion of the array of FIG. 3A after the components to be separated have been cut apart, illustrating in particular the configuration of the carrier body, and showing also an electrical device to be mounted thereon.

In FIG. 3C, the so cut-apart components 30-34, 4, 71-74 of the stamped conductor pattern are shown together with the electrical device 5 to be secured to carrier body 4 and the associated bonding wires 61-64, as well as potting body 85, which encloses carrier body 4, the electrical device 5 placed thereon, and the contact elements 31, 32; 71, 72 inside the connector.

Figure 4A:
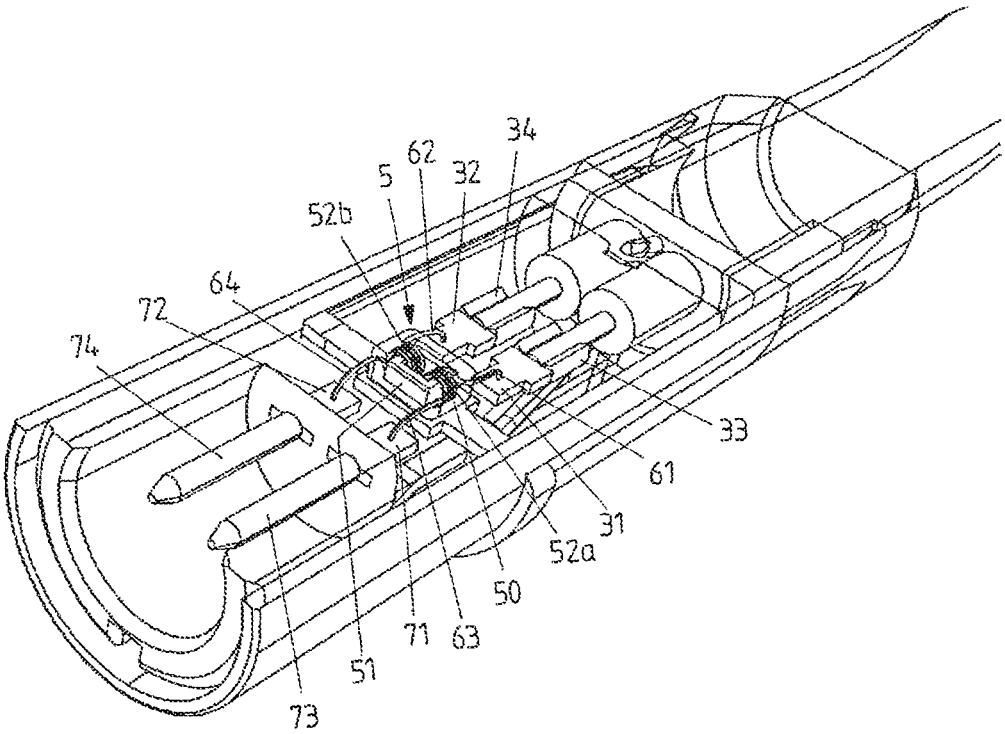
FIG. 4A shows a first specific embodiment of the connector of FIG. 1A, with particular focus on the electrical device.
Figure 4B:
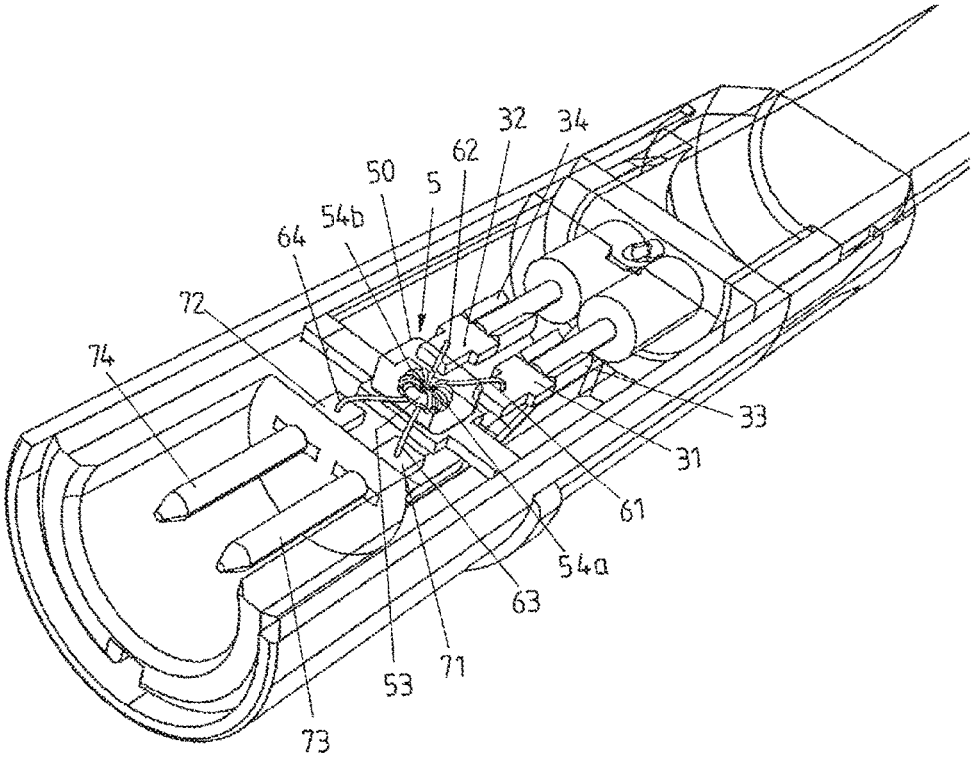
FIG. 4B shows a second specific embodiment of the connector of FIG. 1A, with particular focus on the electrical device.

FIGS. 4A and 4B show, by way of example, two specific embodiments of the electrical connector of FIGS. 1A and 1B, focusing on the design of electrical device 5. For this purpose, housing 50 of electrical device 5 is shown transparently in FIGS. 4A and 4B, so that the components of electrical device 5 that are disposed inside the respective housing 50 are visible.

The electrical devices shown in FIG. 4A, on the one hand, and in FIG. 4B, on the other hand, are alike in that each has a ring-shaped core 51 or 53 (formed from a magnetic material), about which is wrapped at least one winding 52*a*, 52*b* or 54*a*, 54*b* (of an electrically conductive material/wire).

In the exemplary embodiment of FIG. 4A, ring-shaped core 51 is polygonal in shape, and specifically rectangular in shape in the exemplary embodiment, and has two windings 52*a*, 52*b*. These are disposed on opposite legs of ring-shaped core 51. Bonding wires 61, 63 and 62, 64 extend from the two windings 52*a*, 52*b*, respectively, each bonding wire electrically connecting a cable-side electrical contact element 31 or 32 to a respective output-side electrical contact element 71 or 72. In other words, each one of the windings 52*a*, 52*b* of electrical device 5 is connected between a respective one of the cable-side contact elements 31, 32 and the output-side contact element 71 or 72 associated therewith.

The arrangement of the windings of electrical device 5 between cable-side and output-side contact elements 31, 32; 71, 72 such that respective pairs of contact elements 31, 71 and 32, 72 are electrically connected therethrough applies analogously to the embodiment of FIG. 4B.

In the exemplary embodiment of FIG. 4B, ring-shaped core 53 of electrical device 5 is arcuate, and more specifically circular, in shape, and thus has no corners. Accordingly, the two windings 54*a*, 54*b* each extend along an arcuately curved portion of core 53.

The advantages of the polygonal configuration of electrical device 5 reside in particular in the ease of processing in terms of conveying and positioning, and in the ease of attachment to carrier body 4. The advantages of the circular configuration of electrical device 5 reside in particular in its highly symmetrical design and in the possibility of using long windings.

Figure 5A:
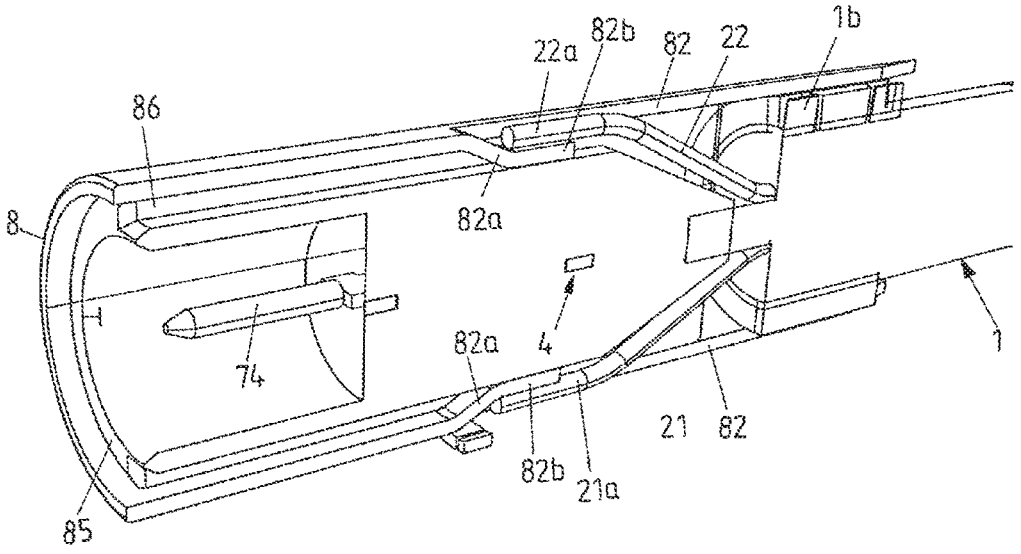
FIG. 5A shows a longitudinal section through the connector of FIGS. 1A and 1B.
Figure 5B:
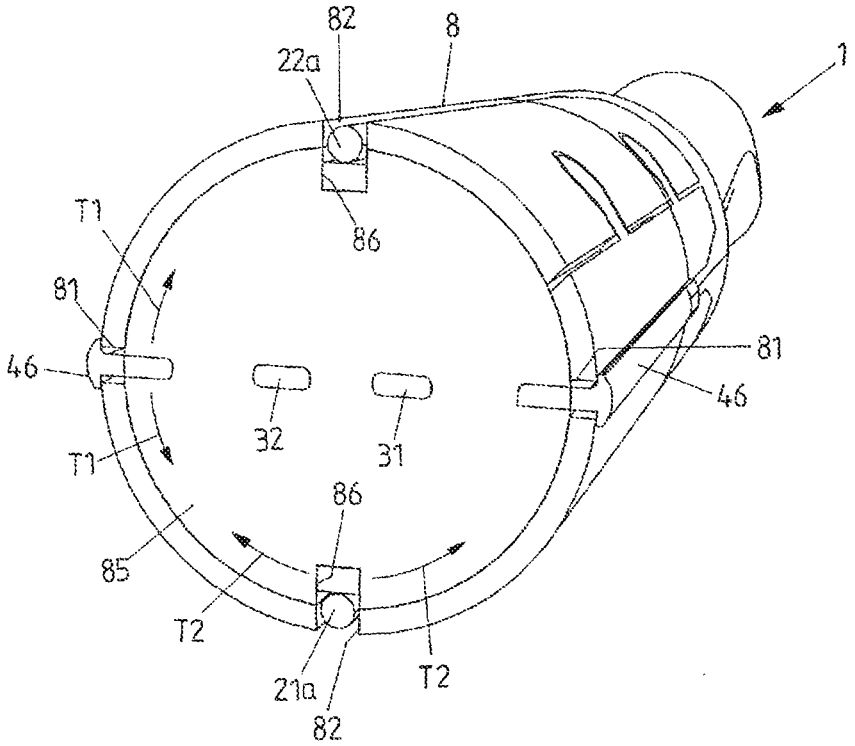
FIG. 5B shows a transverse section through the connector of FIGS. 1A and 1B.

FIGS. 5A and 5B show a longitudinal section (FIG. 5A) and a transverse section (FIG. 5B) through the electrical connector of FIGS. 1A and 1B. These sectional views graphically illustrate in particular the arrangement of axially extending projections 46 of carrier body 4 in first slots 81 of outer conductor 8, on the one hand, and the arrangement of stranded drain wires 21, 22 in second slots 82 of outer conductor 8, on the other hand.

It is also shown, especially in FIG. 5B, how torsional forces T1 acting on outer conductor 8 or on potting body 85 are transferred into carrier body 4, which in the transverse cross-sectional view of FIG. 5B is exemplarily represented by projections 46. In addition, it is shown how torsional forces T2 acting on stranded drain wires 21, 22 are transferred into outer conductor 8 (from where they can in turn be transmitted to carrier body 4). This makes it possible to relieve stranded drain wires 21, 22 from compressive and tensile strains under the action of torsional forces, thus in particular preventing shearing off of the stranded drain wires.

The above-mentioned aspect that carrier body 4, here represented in particular by axially extending lateral projections 46, may serve as a guiding means (in two spatial planes) during sliding on and positioning of outer conductor 8 is also further illustrated here.

Moreover, it becomes clear that an EMC labyrinth is formed by the projections 46 of carrier body 4 covering first slots 81 of outer conductor 8, in particular because of the crimped-edge (or mushroom-shaped cross-sectional) configuration of projections 46, in order to prevent entry of electromagnetic waves into the space surrounded by outer conductor 8.

Specifically, FIG. 5A shows also those regions of second slots 82 which, in the exemplary embodiment, are sloped end portions 82*a* and in the vicinity of which a respective stranded drain wire 21, 22 is fixed (with its respective free end portion 21*a*, 22*a*) to outer conductor 8, for example by a material-to-material bond created by welding, soldering, brazing, adhesive bonding, and the like, and more specifically to a support (plateau 82*b*) formed by the respective end portion 82*a*. In this way, it is also achieved that the ground connection of the cable shield via stranded drain wires 21, 22 to outer conductor 8 remains stable over a long period of time and, in particular, that the contact resistance is constant over time. Sloped end portions 82*a* and the thereby formed supports 82*b* also serve to transmit torsional forces. Furthermore, sloped end portions 82*a* and supports 82*b* form and serve as additional guide means during sliding of outer conductor 8 onto potting body 85.

Figure 6A:
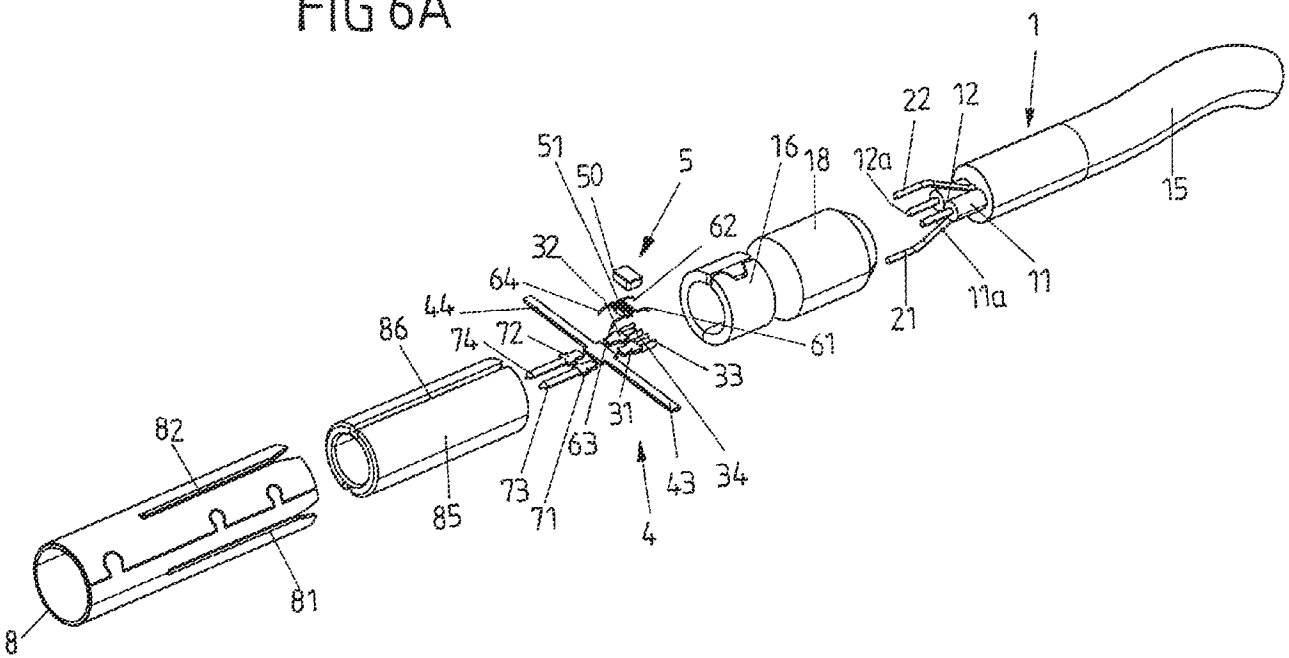
FIG. 6A shows an exploded view of the assembly of FIGS. 1A and 1B prior to bending over the supporting sections of the carrier body.

FIG. 6A shows an exploded view of the electrical connector of FIGS. 1A and 1B together with the components immediately adjacent thereto on the cable side, and specifically prior to bending over the supporting sections 43, 44 of carrier body 4.

On the cable side, FIG. 6 shows electrical cable 1 including wires 11, 12 and their respective conductive cores (electrical conductors 11*a* and 12*a*), as well as stranded drain wires 21, 22 and cable jacket 15. The end of electrical cable 1 facing the electrical connector is provided with the already described support crimp 16, on which in turn is deposited a potting body 18.

Carrier body 4 is configured as described with reference to FIGS. 1A and 1B. It forms an inner core of the electrical connector, which has disposed thereon the electrical device 5 (with its housing 50), which is connected via wires 61, 62, 63, 64 to input-side and output-side electrical contact elements 31, 32; 71, 72.

The connector is surrounded on the outside by the outer conductor 8 having the first and second slots 81 and 82. The space between carrier body 4 and outer conductor 8 is filled with a potting body 85, except for the outwardly extending supporting sections 43, 44.

Based on the exploded view of FIG. 6A, the procedure for assembling the connector, including the attachment of electrical cable 1, may be described as follows:

First, electrical cable 1 is provided and its free end, where the associated electrical connector is to be attached, is provided with support crimp 16. Stranded drain wires 21, 22 of electrical cable 1 have already been separated, as described with reference to FIGS. 2A and 2B.

Subsequently, the stamped conductor pattern is provided, from which carrier body 4 and cable-side and output-side contact elements 31, 32; 71, 72 are formed along with the other components 33, 34; 73, 74 associated therewith. The stripped free ends of wires 11, 12 of electrical cable 1, at which the respectively associated conductive cores in the form of a conductors 11*a*, 12*a* are exposed, are each brought into contact or engagement with a respective cable-side contact element 31, 32 via the respective receptacle 33, 34 thereof. An additional connection is created at the respective contact or engagement region, preferably by a material-to-material bond, for example by soldering, brazing or welding. Further, electrical device 5 is placed on carrier body 4 and fixed thereto (by a material-to-material bond) and electrically connected via wires 61, 62, 63, 64 to the cable-side and output-side contact elements 31, 32; 71, 72.

The components defining the interior of the electrical connector, namely carrier body 4 as well as contact elements 31, 32; 71, 72 and the other components 33, 34; 73, 74 associated therewith, as well as the electrical device 5 disposed on carrier body 4, including the associated wires, are then provided with the insulating potting body 85 by an overmolding process, during which channels 86 are formed.

Figure 6B:
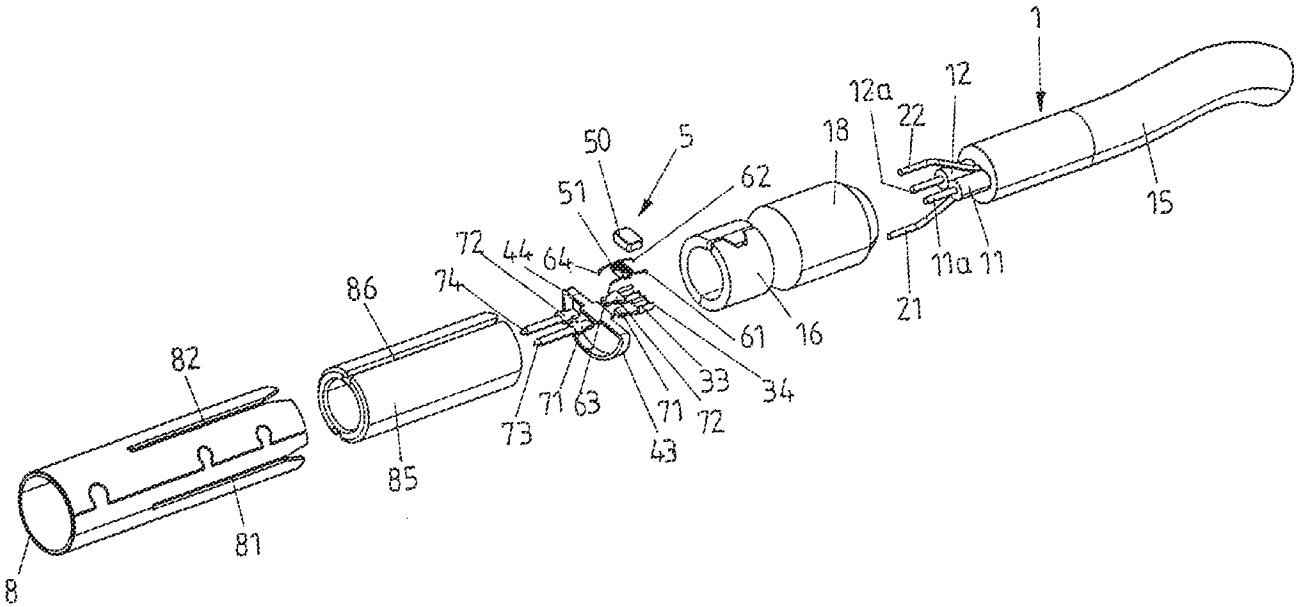
FIG. 6B shows the exploded view as in FIG. 6A, but subsequent to bending over the supporting sections.

Then, outer conductor 8 is slid (by means of first slots 81) over the aforementioned components of the electrical connector. In the process, outer conductor 8 is guided through carrier body 4, as explained above with reference to FIG. 3A. Thereafter, the free end portions 21*a*, 22*a* (compare FIGS. 5A and 5B) of stranded drain wires 21, 22 are inserted into second slots 82 provided in outer conductor 8 for this purpose, where they are fixed by a material-to-material bond, for example by soldering, welding, brazing or adhesive bonding. Moreover, supporting sections 43, 44 of carrier body 4 are bent over as shown in FIG. 6B to form the ring-shaped configuration shown in FIGS. 1A and 1B and are optionally also fixed by a material-to-material bond to outer conductor 8, for example by welding.

Finally, the transition between electrical cable 1 and the connector is provided with overmold 18, which in particular encloses support crimp 16.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An electrical connector for a multi-wire electrical cable, the electrical connector comprising:

at least two cable-side electrical contact elements including associated electrical terminals to each of which is to be connected a wire of the electrical cable;

at least two output-side electrical contact elements, from each of which projects an electrical connector element by which an electrical connection is establishable to a mating connector; and an electrically conductive carrier body disposed between the cable-side contact elements and the output-side contact elements, the electrically conductive carrier body carrying an electrical device by which the cable-side contact elements and the output-side contact elements are electrically connected to each other, the electrical device being supported by the carrier body without any of the cable-side contact elements or the output-side contact elements being in electrical contact with the carrier body through the electrical device.

2. The electrical connector as recited in claim 1, wherein the carrier body forms a support region which extends from a first connecting section to a second connecting section, the electrical device being disposed on the support region, and wherein a supporting section of the carrier body extends from each of the two connecting sections in such a way that the support region and the two supporting sections form a ring-shaped circumferential structure.

3. The electrical connector as recited in claim 2, wherein the two supporting sections each extend along an arcuate path.

4. The electrical connector as recited in claim 2, wherein the two supporting sections each have a free end, and wherein the free ends of the supporting sections face each other.

5. The electrical connector as recited in claim 4, wherein the free ends of the supporting sections are spaced apart.

6. The electrical connector as recited in claim 2, wherein the carrier body is formed as a single piece, and the supporting sections are configured by bending to form an annular contour.

7. The electrical connector as recited in claim 1, wherein the electrical device is electrically connected by wires to the cable-side contact elements and to the output-side contact elements.

8. The electrical connector as recited in claim 1, wherein each of the wires of the electrical cable is connected to a respective one of the cable-side contact elements.

9. The electrical connector as recited in claim 1, further comprising an outer conductor which encloses an interior space of the electrical connector, the carrier body, the cable-side contact elements and the output-side contact elements being at least partially disposed in the interior space, and the outer conductor being fixed to the carrier body.

10. The electrical connector as recited in claim 9, wherein the outer conductor is fixed to the carrier body in a form-fitting manner and/or by a material-to-material bond.

11. The electrical connector as recited in claim 9, wherein the carrier body partially extends out of the outer conductor through first slots of the outer conductor.

12. The electrical connector as recited in claim 11, wherein the carrier body forms a support region which extends from a first connecting section to a second connecting section, the electrical device being disposed on the support region, wherein a supporting section of the carrier body extends from each of the two connecting sections in such a way that the support region and the two supporting sections form a ring-shaped circumferential structure, wherein the support region of the carrier body, together with the electrical device, is located within the interior space enclosed by the outer conductor, and wherein the carrier body extends out of the outer conductor at the connecting sections.

13. The electrical connector as recited in claim 12, wherein the supporting sections of the carrier body enclose an outer side of the outer conductor.

14. The electrical connector as recited in claim 1, wherein the cable-side contact elements, the output-side contact elements and the carrier body are separate, spaced-apart components.

15. The electrical connector as recited in claim 1, wherein the cable-side contact elements, the output-side electrical contact elements and the carrier body for the electrical device are manufactured as parts of a single, integrally formed component.

16. The electrical connector as recited in claim 15, wherein the single, integrally formed component is in the form of a stamped conductor pattern.

* * * * *